United States Patent [19]

Takahashi et al.

[11] 4,065,598

[45] Dec. 27, 1977

[54] PROCESS FOR POLYMERIC MODIFICATION OF A FIBER

[75] Inventors: Kooji Takahashi, Otsu; Tatsuji Kojima, Kyoto; Teruo Ishikawa, Otsu; Kimio Nakamura, Otsu; Shizuyoshi Ikenaga, Otsu, all of Japan

[73] Assignee: Toray Industries, Inc., Tokyo, Japan

[21] Appl. No.: 777,655

[22] Filed: Mar. 15, 1977

Related U.S. Application Data

[63] Continuation of Ser. No. 559,176, March 17, 1975, abandoned, which is a continuation-in-part of Ser. No. 279,322, Aug. 10, 1972.

[51] Int. Cl.[2] ..... B32B 27/00; D02G 3/00

[52] U.S. Cl. ..... 428/394; 427/377; 427/390 B; 427/430 R; 428/395; 428/267; 428/265; 8/115.6; 252/8.6; 526/320; 560/126

[58] Field of Search ..... 427/377, 430 R, 390 B, 427/DIG. 3; 428/394, 395, 267, 265; 8/115.6; 252/8.6, 8.8 R; 260/89.5 R, 486 B

[56] References Cited

U.S. PATENT DOCUMENTS

| | | | |
|---|---|---|---|
| 2,516,064 | 7/1950 | Marks | 260/89.5 R |
| 2,628,178 | 7/1950 | Burnett et al. | 260/89.5 R |
| 2,694,696 | 11/1954 | Melamed | 260/77.5 |
| 2,767,107 | 10/1956 | Young et al. | 260/89.5 R |
| 2,815,369 | 12/1957 | Holt | 252/8.6 |
| 2,839,430 | 6/1958 | Rimmer | 428/394 |
| 2,839,431 | 6/1958 | Rimmer | 428/394 |
| 2,841,567 | 7/1958 | Blanton et al. | 260/29.6 |
| 3,065,110 | 11/1962 | Hagge et al. | 428/394 |
| 3,164,481 | 1/1965 | Shibe | 106/10 |
| 3,213,053 | 10/1965 | Kendrick | 260/29.6 |
| 3,236,685 | 2/1966 | Caldwell et al. | 428/265 |
| 3,277,071 | 10/1969 | Press | 260/232 |
| 3,424,609 | 1/1969 | Carl et al. | 428/394 |
| 3,519,561 | 7/1970 | Kelly et al. | 252/8.8 |
| 3,702,231 | 11/1972 | Dale | 428/395 |
| 3,717,689 | 2/1973 | Tanaka et al. | 428/394 |
| 3,770,494 | 11/1973 | Shichijo et al. | 428/394 |

FOREIGN PATENT DOCUMENTS

| | | | |
|---|---|---|---|
| 731,667 | 2/1943 | Germany | 428/394 |
| 875.71 | 11/1971 | Japan | 428/394 |

*Primary Examiner*—Ronald H. Smith
*Assistant Examiner*—Sadie L. Childs
*Attorney, Agent, or Firm*—Miller & Prestia

[57] ABSTRACT

A process for imparting antistatic, soil release and water-absorbing properties to a synthetic fiber structure which comprises adhering the following agent (A) or (B): to the fiber structure A. a compound selected from the group consisting of diacrylate, dimethacrylate, triacrylate and trimethacrylate compound having a polyalkylene oxide segment which has a molecular weight of from 400 to 10,000 and which includes an alkylene substituent selected from the group consisting of ethylene groups, propylene groups and a mixture of ethylene groups and propylene groups B. a mixture of a. a compound selected from the class consisting of propylene glycol methacrylate, methoxy polyethylene glycol acrylate, methoxy polyethylene glycol methacrylate, ethoxy polyethylene glycol acrylate, ethoxy polyethylene glycol methacrylate, chlorinated polyethylene glycol methacrylate, polypropylene glycol methacrylate, methoxy polypropylene glycol acrylate, polypropylene glycol acrylate, methyl sulfide polyethylene glycol methacrylate and compounds having a vinyl group as a side chain as follows:

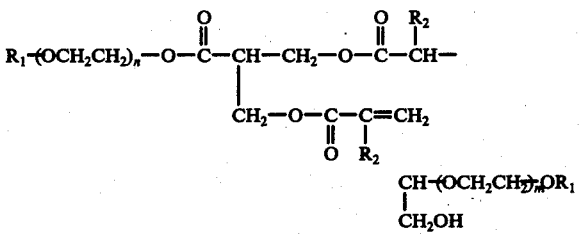

wherein $R_1$ and $R_2$ represent hydrogen, methyl or ethyl, and wherein *n* & *m* are integer from 5 – 500, the molecular weight of whose polyalkylene oxide segment is 400 – 10,000; with b. a compound selected from the group of a diacrylate, dimethacrylate, triacrylate or trimethacrylate compound having a polyalkylene oxide segment which has a molecular weight of from about 400 – 10,000 and which includes alkylene groups, propylene groups and mixtures thereof.

the mix ratio of the compound (b) being about 3.0 – 50.0% by weight based on the solid portion of the compound (a), and heat-treating the adhered fiber structure in the presence of moisture, whereby polymerization is carried out as a film on the fiber, and the surface of the fiber is covered with a polymer film of said compound, the film having a thickness of about 0.01 – 10$\mu$.

33 Claims, No Drawings

PROCESS FOR POLYMERIC MODIFICATION OF A FIBER

DETAILED DESCRIPTION OF THE INVENTION

This is a continuation of application Ser. No. 559,176 filed Mar. 17, 1975, and now abandoned, which is a continuation-in-part of our co-pending U.S. Pat. application Ser. No. 279,322, filed Aug. 10, 1972.

The present invention relates to a process for the preparation of a synthetic fiber structure.

Heretofore, a compound having electric conductivity has been mixed with a polymer before being formed into fibers, for imparting antistatic properties to synthetic fibers and to woven or knitted fabrics thereof. For example, polyalkylene glycol and various surface active agents have been suggested for this purpose. However, this tends to harm the inherent characteristics of the fibers, because a different kind of compound has been added to the fibers. Further, in order to contribute good antistatic properties, it is necessary to add a large amount of antistatic agent, and when the resulting fiber is subjected to melt spinning, or to a drawing step, yarn breakage and napping often take place, seriously affecting the quality of the yarn. Therefore, when such yarn is textured, the fiber breaks in a fibrillar state or whitens in a gray pattern when clothing made of such yarn is worn.

It has been suggested also to apply a surface active agent having antistatic properties or an after-processing agent which may become an antistatic processing agent, by adhering it to the surfaces of fibers of a synthetic fiber filament, yarn or a woven or knitted fabric. Such adherents include amines, amides and quaternary ammonium salts, or compounds containing polyglycols, aliphatic and aromatic polyglycol ethers and derivatives thereof. They also include after-processing agents such as aryl alkyl sulfuric acid esters, phosphoric acid esters, members of the sulfonic acid series and of the phosphoric acid series, and polyhydric alcohols and derivatives thereof, all of which must adhere to the surface of the synthetic fiber. A fiber whose antistatic properties have been improved by such a method tends to have poor durability, and when a product of such fiber is washed at home 3 times, it completely loses its antistatic properties. Further, fabrics made of a fiber whose antistatic properties have been improved by a cationic antistatic processing agent become tainted by washing.

These fibers do not have reaction groups reacting with the adhering compounds. Accordingly, said compounds are merely mixed and easily bleed out in the presence of water or a solvent. As a matter of fact, many processes using after-treatment methods have been proposed. However, none of the products of such processes is excellent in washing resistance and weatherability. Moreover, many such products are remarkably harmed with respect to feel or "hand."

We are also aware of a method of graft polymerizing acrylic acid, styrene and glycidyl methacrylate to a synthetic fiber and converting said fiber to an alkali metal salt, especially the sodium salt and the potassium salt. However, in this method, only sodium or potassium have antistatic properties; calcium or magnesium salts cannot develop antistatic properties. But in actual use, in ordinary washing water, calcium, magnesium and iron are present, and because such calcium and magnesium easily interchange ions with the aforesaid sodium and potassium salts, the antistatic effect disappears when a product of such fiber is washed for 2 or 3 times.

Furthermore, because a graft polymer fiber generally has the defect of remarkably lowering dyeability and Young's modulus, in order to impart excellent antistatic properties to such fiber, the fiber's physical characteristics have to be sacrificed, and such fibers have not been practical.

An object of the present invention is to solve such conventional defects, and to provide a synthetic fiber structure having antistatic, soil release and water-absorbing properties possessing practical durability.

In order to achieve the aforesaid object, one kind of processing agent selected from the following (A) and (B), is adhered to a synthetic fiber structure, and thereafter the adhered fiber structure is heat treated in the presence of moisture to effect polymerization of the processing agent on the surface of the synthetic fiber structure.

A. is a compound selected from the group consisting of diacrylate, dimethacrylate, triacrylate and trimethacrylate compound having a polyalkylene oxide segment which has a molecular weight of from 400 – 10,000 and which includes an alkylene substituent selected from the group consisting of ethylene groups, propylene groups and a mixture of ethylene groups and propylene groups.

B. is a mixture of a. a compound selected from the class consisting of propylene glycol methacrylate, methoxy polyethylene glycol acrylate, methoxy polyethylene glycol methacrylate, ethoxy polyethylene glycol acrylate, ethoxy polyethylene glycol methacrylate, chlorinated polyethylene glycol methacrylate, polypropylene glycol methacrylate, methoxy propylene glycol acrylate, polypropylene glycol acrylate, methy sulfide polyethylene glycol methacrylate and compounds having a vinyl group as a side chain as follows;

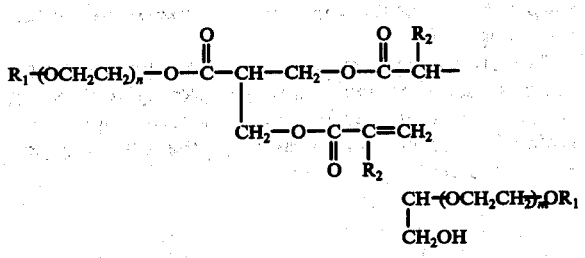

wherein $R_1$ and $R_2$ represent hydrogen, methyl or ethyl, and wherein n & m are integer from 5 – 500, the molecular weight of whose polyalkylene oxide segment is 400 – 10,000; with b. a compound selected from the group of a diacrylate, dimethacrylate, triacrylate or trimethacrylate compound having a polyalkylene oxide segment which has a molecular weight of from about 400 – 10,000 and which includes alkylene substituents selected from the group consisting of ethylene groups, propylene groups and mixtures thereof, the mix ratio of the compound (b) being about 3.0 – 50.0% by weight based on the solid portion of the compound (a).

It is also possible to achieve the effect of the present invention by causing either (D) or (E) (in addition to the processing agent of (A) or (B)) to adhere to said fiber structure and heat-treating the adhered fiber structure in the presence of moisture. The agent (D) is a cationic antistatic agent and (E) is an alkylethylene urea derivative represented by the general formula:

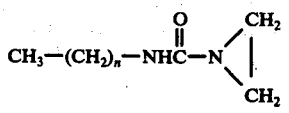

(wherein $5 \leqq n \leqq 30$).

In a synthetic fiber structure having durable antistatic, soil release and water-absorbing properties prepared by the aforesaid process of the present invention, the surface of a synthetic fiber such as polyamide, polyester, polyacrylonitrile or polyolefin is covered by a polymer film of the processing agent with a thickness of 0.01 - 10μ, preferably 0.1 - 3μ.

Such antistatic synthetic fiber structures of the present invention have unprecedentedly durable antistatic properties and, at the same time, soil release and water-absorbing properties.

The processing agent (A) used in the present invention is a vinyl monomer of a polyalkylene glycol having at least two acrylic and/or methacrylic groups in one molecule as shown, for example, by the following general formulae:

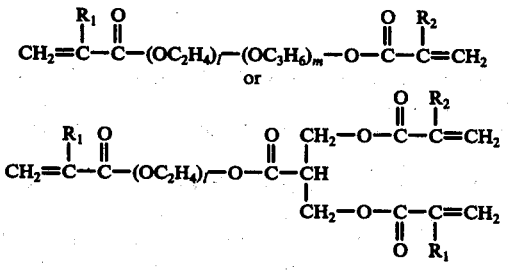

(wherein $R_1$ and $R_2$ may be the same or different, standing for H or $CH_3$, $0 \leqq m \leqq 1$, $1 = 5 - 500$)

Among such processing agents, (A) we mention, for example, polyethylene glycol dimethacrylate, polyethylene glycol diacrylate, polyethylene glycol triacrylate, di- or tri-methacrylate of block polyalkylene glycol of polyethylene oxide and polypropylene oxide, and acrylate and methacrylate derivatives of polyalkylene oxide represented by the following general formulae:

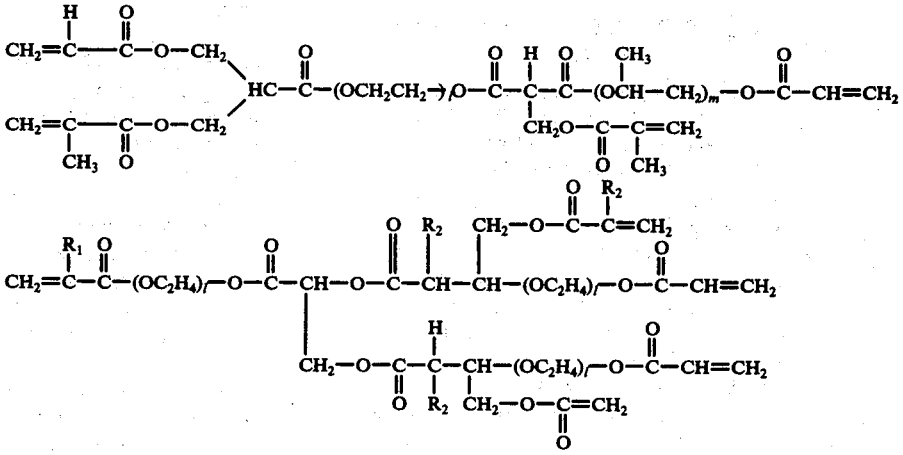

(wherein $R_1$, $R_2$, $l$ and $m$ are as defined above).

The processing agent (B) used in the present invention is obtained by mixing a polyalkylene glycol monovinyl compound with a monomer of the vinyl series having at least two vinyl groups, namely, a polyfunctional vinyl compound. The polyalkylene glycol monovinyl compound herein referred to is a compound the molecular weight of whose polyalkylene oxide segment is 400 - 10000, preferably 800 - 4000. Examples include polyethylene glycol methacrylate, methoxy polyethylene glycol acrylate, methoxy polyethylene glycol methacrylate, ethoxy polyethylene glycol acrylate, ethoxy polyethylene glycol methacrylate, chlorinated polyethylene glycol methacrylate, polypropylene glycol acrylate, polypropylene glycol methacrylate, methoxy polyproylene glycol acrylate, methyl sulfide polyethylene glycol methacrylate and compounds having a vinyl group at a side chain as follows:

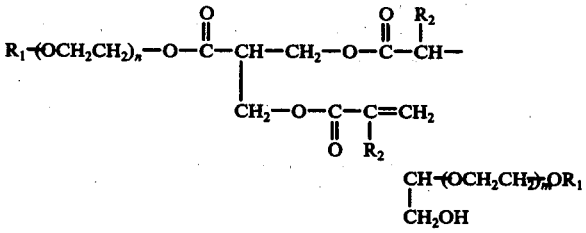

(wherein $R_1$ and $R_2$ stand for hydrogen, methyl group or ethyl group, and m & n stands for an integer of 5 - 500), however, the polyalkylene glycol monovinyl compound is not limited to the foregoing.

The reason the molecular weight of the polyalkylene oxide segment is limited to that mentioned above is that when the molecular weight is less than 400, the objective effect of the present invention cannot be sufficiently developed and when it exceeds 10,000, the synthesis of the compound becomes so difficult as to be impractical.

With respect to the polyfunctional vinyl compound, such compounds of the diacrylate and triacrylate series as mentioned above may be cited; however, the compound is not so limited.

The processing agent (B) is obtained by mixing the monovinyl compound as illustrated above with the polyfunctional vinyl compound, making the resulting mixture a dispersed liquid or solution of water or an organic solvent, adhering such liquid or solution to the synthetic fiber structure and then treating the adhered structure with steam. As to the mixing ratio of these compounds, when the polyfunctional vinyl compound is present in an amount of 3.0 - 50.0% by weight, preferably 5.0 - 40.0% by weight based on the solid portion of the monovinyl compound, the effect of the present invention becomes remarkable.

In the present invention, as mentioned above, either one of the cationic antistatic agents (D) or the alkyl ethylene urea and derivative thereof (E) may be used in addition to the processing agent (A) or (B). The cationic antistatic agent as herein referred to includes, for example, a compound having a poly $\beta$-methacryloxy ethyl diethyl methyl ammonium methosulfate as the main component, and as a compound of the quaternary ammonium salt series, alkyl trimethyl ammonium salt, dialkyl-dimethyl ammonium salt, alkyl tributyl ammonium salt and alkyl dimethyl benzyl ammonium salt, alkyl pyridinium salt, alkyl morpholinium salt, alkyl imidazolinium salt and compounds represented by the following general formulae:

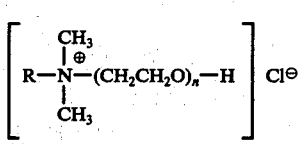
(1)

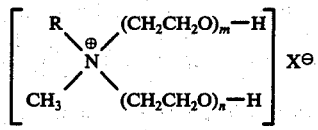
(2)

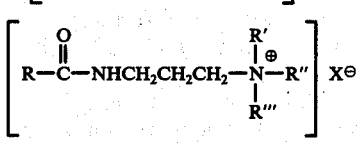
(3)

(wherein R, R', R'' and R''' may be same or different, standing for H or a lower alkyl group, X stands for a halogen, m and n may be same or different and $5 \leqq n \leqq 30$ and $5 \leqq m \leqq 30$).

The aforementioned alkyl ethylene urea and the derivative thereof are represented by the following general formula, preferably a saturated alkyl ethylene urea having 4–19 carbon atoms. Octadecyl ethylene urea is most effective.

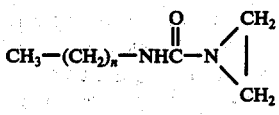

(wherein $5 \leqq n \leqq 30$).

The present invention combines and blends such compound (D) or (E) as illustrated above with one of the processing agents of (A) - (B), forming the blend as an organic solvent solution, aqueous dispersed liquid or solution, and thereafter making such solution or liquid adhere to the synthetic fiber structure and heat-treating the adhered structure with steam. At this time, it is preferable that the adhered amount of a mixed solution of such compounds is 0.03 - 10% by weight, preferably 0.03 - 7% by weight, calculated as solid, based on the weight of the fiber. For treatment with steam used in the present invention, no special apparatus is required, but by an apparatus heretofore used at a dye works, the adhered synthetic fiber structure was found to be processable either continuously or batch-wise. However, except in a special case, dry heat treatment is not preferred because by such treatment the objective effect of the present invention usually cannot be achieved. With observation under a microscope, a product subjected to treatment with steam forces a uniform and smooth film, whereas one subjected to dry heat-treatment has considerable unevenness and locally forms a film.

When one attempts to obtain formation of a good film by treatment with steam, the object may be achieved when the atmosphere contains about 80 - 100% of steam. The conditions for treatment with steam are not particularly limited; however, treatment at 80° - 150° C for 60 - 900 seconds is preferable in terms of cost. Also, by treatment in heated vapor of an organic solvent without dissolving a polyalkylene glycol monovinyl compound, the effect of the present invention is almost completely obtained.

Further, in the aforesaid heat polymerization of the present invention, a polymerization initiator may be concurrently used, such as ammonium persulfate, potassium persulfate, benzoyl peroxide and azobisisobutylonitrile. And by selecting the kind of such polymerization initiator, it is possible to carry out a covering treatment under desired and selected conditions. Specifically, if a redox polymerization initiator is used, it is possible to obtain a film meeting the object of the present invention at a lower temperature. In order to form a polymer film of the present invention on a hydrophobic in the treating liquid to be mentioned later, it is necessary to utilize a hydrophobic polymerization initiator. With a hydrophilic polymerization initiator it is not possible to impart the effect of the present invention to a hydrophobic fiber.

Next, in the present invention, by positively supplying oxygen or air into a treating liquid containing monomers of the vinyl series as in said (A) and (B), it is possible to maintain the life of the treating liquid permanently and continue the treatment of the present invention for a long period of time. Heretofore, the life of the treating liquid in such processing treatment with a resin of the vinyl series has been held as a problem. For the purpose of improving such life, either a polymerization initiator has been blended with the treating liquid or the reaction system has been kept at a low temperature. However, such methods have the defect that they bring about coloration phenomena or excessively prolong the polymerization period.

The process of the present invention has eliminated such conventional defect. It continuously treats the synthetic fiber structure while positively pouring oxygen at a flow ratio of at least 2.1 cc/liter·min into the treating liquid containing the monomer of the vinyl series and the polymerization initiator. On this occasion, the temperature of the treating liquid may be elevated to a proper temperature and from the viewpoint of decomposition of the polymerization initiator and formation of a polymer film, a temperature within the range of 0° - 60° C is practical. According to the experimental examination of the amount of oxygen, continuous pouring at 20° C at a ratio of at least 2.1 cc/liter·min will suffice. When using air, at a ratio of at least 10 cc/liter·min, the treating liquid can be held sufficiently without causing initiation of polymerization. Accordingly, while the fiber structure is being treated continuously, by air contained in the structure, such an amount of oxygen is sufficiently maintained. Therefore, it is unnecessary to pour further oxygen while the fiber structure is being treated continuously. What is necessary is to prevent gelation of the treating liquid and to that end, so long as the gross amount of oxygen supplied is at least 2.1 cc/liter·min, it is possible to maintain the life of the treating liquid. In case the treating liquid of the present invention is necessarily used at a high temperature, as when it is used for dyeing, for example, decomposition and disappearance of the polymerization initiator are inevitable. Therefore, by properly adding and supplementing the initiator, it is possible to treat the fiber structure without hindrance.

When the process of the present invention is used, it is possible to stabilize permanently the treating liquid, without its being affected by temperature, no change being brought about as time goes by. It becomes possible to practice good resin processing, and accordingly the quality of the product is stabilized. In addition, the treatment becomes operationally very advantageous.

With respect to the method of causing such treating liquid to adhere to said fiber structure in the present invention, any immersing method, padding method, coating method or spraying method is sufficient, insofar as it is capable of covering the fiber structure.

The fiber structure, consisting of synthetic fiber, as used in the present invention, is composed of synthetic fibers such as polyamide, polyester, polyacrylonitrile, polyolefin and polyurethane as well as those fibers whos qualities have been modified, and the structure includes knitted and woven fabrics, non-woven fabrics, filaments, yarns, tows and films composed of so-called synthetic fibers or natural fibers and fibers of the cellulose series as well as mixed fibers and mix-spun fibers thereof. However, said structure is not limited by methods of preparing these fibers, constitutional components or arranged forms.

A polyester fiber is obtained by freely combining an aliphatic dicarboxylic acid such as sebacic acid or adipic acid, or an aromatic dicarboxylic acid such as terephthalic acid, isophthalic acid, 2-6 naphthalenedicarboxylic acid or diphenic acid, with ethylene glycol or butylene glycol and condensing the resulting combination (mixture) as well as a fiber consisting of a polyester polymer containing other polyesters.

A polyamide fiber is obtained by condensation polymerization of an aliphatic dicarboxylic acid such as adipic acid or sebacic acid, an aromatic dicarboxylic acid such as phthalic acid, isophthalic acid, terephthalic acid, 2,6-naphthalenedicarboxylic acid or diphenic acid, and a dicarboxylic acid having an aliphatic ring or heterogeneous ring such as 1,2-cyclobutanedicarboxylic acid or 2,6-dicarboxypyridine; an aliphatic diamine such as hexamethylene diamine; an aromatic diamine such as p-xylylene diamine and m-xylylene diamine; a lactam such as $$\underbrace{OC-(CH_2)_n-NH}$$

(n = 3, 4, 6, 8, 10, 11); or aminocaproic acid.

Said polyacrylonitrile is a homopolymer or copolymer of acrylonitrile. Methyl methacrylate, vinyl chloride, vinylidene chloride, vinyl acetate, styrene, sodium styrenesulfonate and sodium allylsulfonate may be cited as another constitutional component of the copolymer. These may be used alone or at least two kinds thereof may be mixed and copolymerized.

Said polyolefin fiber is a fiber obtained from ethylene and propylene.

Further, said synthetic fibers whose qualities have been modified include polyester obtained by blending with said synthetic high polymer of the polyester series, compounds represented by the following general formula singly or in proper combination:

$$R-Ar-X \quad (4)$$

$$R-Ar-W-X \quad (5)$$

(wherein R stands for an alkyl group having 2 – 18 carbon atoms, Ar stands for an aromatic hydrocarbon residual group or phenol nucleus; X stands for an acidic group or a salt thereof, W stands for $$-(CH_2)_n- \text{ or } -(CH_2CH_2O)_n- \text{ and} \quad (6)$$

n = 2 – 16)

$$R'-O-(\overset{R''}{\overset{|}{C}}HCH_2O)_n-H$$

(wherein R′ stands for hydrogen or an alkyl group, R″ stands for hydrogen or $CH_3$, $C_2H_5$ or may have these substituents in one molecule, being copolymerized; and $n = 2 - 500$) or a shaped structure of the polyester series containing a block polyetheramide containing 15 – 85% of a polyalkylene ether segment in an amount of 0.1 – 5% by weight calculated as said polyalkylene ether segment.

The effects obtained in the use of such fiber, whose quality has been modified, are that an antistatic property equivalent to that of cotton is obtained, the fiber is excellent in soil release and water-absorbing properties, the electrostatic obstruction of a clothing composed of such fiber is eliminated as well as non-absorption of perspiration and graying of said fiber (product) during washing, all of which are inherent defects of clothing obtained from such an eleophilic polymer as polyester fiber.

Referring to the polyamide fiber whose quality has been modified, this includes, for example, block polyether amide, that is a block copolymer consisting of a polyether segment the content of whose polyether portion is 15–85% by weight bound in the form of a straight chain to a polyamide segment.

Such a block polyether amide is prepared by polycondensing a monomer for forming a polyamide such as, for example, lactams ω-amino acid or a diamine and a dicarboxylic acid in the presence of a polyether having an amino group at its end or an organic acid salt thereof, or polycondensing in the solution or molten state, the polyether having an amino group, a carboxyl group or an amino group and a carboxyl group at its end, and polyamide having a carboxyl group, an amino group or a carboxyl group and an amino group at its end.

The polyamide whose quality has been modified as in the present invention is said block polyetheramide or a mixture of said polyether amide and polyamide, essentially having an antistatic property per se, and formed so that the final content of the polyether segment may become 0.1 – 20% by weight, preferably 0.3 – 10% by weight.

As mentioned above, the synthetic fiber whose quality has been modified according to the present invention is not obtained by graft polymerization. Accordingly, it is unnecessary to impart the center of polymerization activity. Further, the fiber per se has antistatic properties. The present invention further makes the processing agent adhere to the synthetic fiber the quality of which has been modified, and heats the adhered fibers in the presence of moisture, preferably in aqueous steam or the vapor of an organic solvent.

The fiber so obtained may develop a further excellent effect in accordance with the present invention due to the synergistic effect of the antistatic property of the fiber per se and the polymer cover of said processing agent.

One can apply the process of the present invention to a knitted or woven fabric of the synthetic fiber, having a fiber density of less than 0.5 g/cm$^3$, and the resulting fabric has excellent durability. The processing agent (A) or (B) adheres and thereafter said processing agent is polymerized.

The fiber density, as referred to in the present invention, is obtained by multiplying the thickness of the fabric measured under a load of 3 g/cm$^2$ by the area of the fabric to calculate the volume of the fabric and dividing the weight of the fabric by said volume.

The density, calculated by such a method, of taffeta or twill is about 0.7 – 1.1 g/cm$^3$, which is comparatively high. However, when the woven or knitted fabric is made of a mixed yarn consisting of said synthetic fiber and a comparatively bulky fiber such as rayon or cotton, it is possible to lower the density to about 0.1 – 0.4 g/cm$^3$. When such knitted or woven fabric, having a density of less than 0.5 g/cm$^3$, is treated with said processing agent, as is made clear hereinafter and particularly in Example 6, very excellent antistatic properties are obtained which cannot be obtained by using other general antistatic agents. The low-density knitted or woven fabric so obtained is remarkably excellent in washing resistance and endures washing through 50 cycles using a standard domestic electric washing machine. And because of the low density of a knitted or woven fabric, and the fact that a film was formed on each monofilament, the feel or hand of the fabric is not hardened. A very good product with excellent durability is obtained. Because said processing agent has excellent hydrophilic properties, the product has excellent water-absorbing and soil release properties at the same time. These characteristics are very important upon applying the product of the present invention to shirts and sportswear.

In the present invention, when treating a hydrophobic fiber, when such treating methods as mentioned above are used, it is difficult to impart the effect of the present invention to the hydrophobic fiber. Each of said processing agents used in the present invention is a hydrophilic monomer or polymer, and it is very difficult generally to polymerize a hydrophilic monomer on the surface of a hydrophobic fiber. This is because it is difficult to cause the treating liquid and processing agent to adhere to the surface of a hydrophobic fiber due to the properties of such fiber. When processing a product such as a flexible knitted fabric, a sweater or knit womens' wear obtained by directly knitting the filaments or yarn, the padding steam process by a steam method is technically difficult. Because of that, we have developed a method of efficiently causing polymerization on the surface of a hydrophobic fiber in a solution. Specifically, upon treating a hydrophobic fiber structure in a treating liquid consisting mainly of the processing agent (A) of the present invention, said liquid is caused to adhere to the surface of said structure and to polymerize on the surface of said structure using a dispersed system of a hydrophobic polymerization initiator. At this time, the temperature of the treating bath is elevated to that necessary for initiating polymerization.

The polymerization initiator used in the present invention is especially important in the present invention. A substantially water-insoluble hydrophobic polymerization initiator, for example, finely divided particles of a water-insoluble polymerization initiator such as benzoyl peroxide, acetyl peroxide, t-butyl hydroperoxide, peroxy carbamates, 2,2'-azobisisobutyronitrile and tetramethylthiuram disulfide, or these initiators stabilized mixed with, for example, magnesium sulfate, are used. In the present invention, with a water-soluble initiator such as, for example, ammonium persulfate, potassium persulfate and hydrogen peroxide, sufficient polymerization is not obtained by immersing such an aqueous solution system as compared to the present invention.

In the present invention, dispersed particles of a hydrophobic initiator are adsorbed on the surface of a hydrophobic fiber in water, and the vinyl monomer dissolved in water on said fiber only is polymerized. Also, it is possible to carry out a low-temperature polymerization by introducing a redox type polymer as said initiator.

Further, the process of the present invention is characterized in that polymerization takes place in a reaction system wherein oxygen co-exists. Accordingly, a monomer containing an atom of quaternary nitrogen cannot be polymerized in a process such as that of the present invention. Again, if the fibrous material is cotton, hemp, a fiber of the polyvinyl alcohol series or polyamide, adsorption of a hydrophobic polymerization initiator on the surface of the material does not take place because the material per se is hydrophilic, and the effect of the present invention does not appear.

Next, explanations will be made with reference to methods of measuring the antistatic properties, water-absorbing properties and adhered amount in examples of the present invention.

A sample treated according to the present invention is left to stand for 5 hours in a temperature and humidity controlled chamber at 20° C and a relative humidity of 65%. Thereafter the adhered amount is measured. Further, the sample is left to stand for 15 hours at 20° C and a relative humidity of 40%. Thereafter, the amount of static electricity is measured.

1. Amount of static electricity (V)
   - Measuring machine: Rotary static tester (manufactured by Koa Shokai, Japan)
   - Objective fabric of rubbing: 50 count broad cloth of cotton
   - Measuring conditions: 20° ± 1° C, humidity 40 ± 1%

The amount of static electricity (V) is reported as an average of 5 measurements.

2. Durability:
   - Washing machine: Electric washing machine manufactured by Tokyo Shibaura Electric Co., Ltd.
   - Detergent: "Zabu," a detergent manufactured by Kao Soap Co., Ltd.
   - Concentration used: 0.2% by weight
   - Washing conditions: 40° C × 10 min.

After a sample is subjected to such washing as mentioned above, it is subjected to drying as follows:

Dryer: Domestic dryer manufactured by Osaka Gas Co., Ltd.

Drying conditions: 70° C × 10 min.

The foregoing is referred to as a single washing. A sample subjected to 10 such washings is referred to as the "sample after washing". It is a matter of course that the sample subjected to such treatment is left to stand in said temperature and humidity controlled chamber and thereafter measured. A sample washed for zero time is a sample prior to the aforesaid washing treatment.

3. Adhered amount:

This is shown by the percentage difference between the weight of a sample before and after the treatment to the weight of the sample before the treatment.

$$\text{Adhered (amount)}_{ratio}(\%) = (W - W_o/W_o \times 100$$

wherein $W_o$: Weight of the sample before the treatment

W: Weight of the sample after the treatment

In the examples which follow, the expression "falling ratio" is used. This is measured according to the method of measuring the adhered ratio. The falling ratio is the percentage of material falling off or removed after washing in relation to the adhered amount possessed by the sample washed for zero time.

4. Water-absorbing property:

One drop of water (0.004 cc/drop) is dropped onto a sample from a position 5 cm high and the time is measured until the drop is completely absorbed. The lesser the time, the better the water-absorbing property.

Hereinbelow, various facets of the present invention will be explained specifically by reference to examples.

EXAMPLE 1

A 250 denier/84 filament polyethylene terephthalate yarn was false twisted, woven into a fabric, and the fabric subjected to relaxed scouring by conventional methods. Thereafter, it was dried and subjected to such treatments as shown in m1 – m5 according to the present invention. The adhered amount and the amount of static electricity of these fabrics are shown in Table 1.

The composition of the treating liquid and the treating conditions of the polymerizable compound were as follows.

Sample m1: A 3% by weight aqueous solution of polyethylene glycol dimethacrylate, the molecular weight of whose polyoxyethylene segment was 500, added with 0.3% by weight of a polymerization initiator of ammonium persulfate (APS).

Sample m2: A 3% by weight aqueous solution of polyethylene glycol dimethacrylate the molecular weight of whose polyoxyethylene segment was 1000, added with 0.3% by weight of a polymerization initiator of APS.

Sample m3: A 3% by weight aqueous solution of polyethylene glycol dimethacrylate the molecular weight of whose polyoxyethylene segment was 2000, added with 0.3% by weight of a polymerization initiator of APS.

Sample m4: A 3% by weight aqueous solution of polyethylene glycol trimethacrylate the molecular weight of whose polyoxyethylene segment was 1000, added with 0.3% by weight of a polymerization initiator of APS.

Sample m5: A 3% by weight aqueous solution of polyethylene glycol monomethacrylate the molecular weight of whose polyoxyethylene segment was 1000, added with 0.3% by weight of a polymerization initiator of APS.

Each of the aforesaid 5 kinds of solution different in molecular weight and structure of polyethylene glycol, was uniformly squeezed by a padder and the adhered amount was adjusted to 88% by weight. Next, the fabric was treated at 105° C for 3 minutes in the presence of heated aqueous vapor and thereafter the unreacted substance was soaped in water at 50° C containing 0.05% by weight of a cake of ordinary soap to remove said substance and thereafter washed with water and dried.

Table 1

| M* W* | Adhered amount (%) | | | Amount of static electricity (V) | |
|---|---|---|---|---|---|
| Sample m | Before | After | Falling ratio | Before | After |
| 1 | 2.42 | 2.19 | 9.50 | 522 | 826 |
| 2 | 2.33 | 2.11 | 9.44 | 259 | 310 |
| 3 | 2.38 | 2.12 | 10.92 | 248 | 292 |
| 4 | 2.65 | 2.28 | 6.94 | 251 | 283 |
| 5 | 1.10 | 0.41 | 62.75 | 1205 | 3252 |
| Blank | — | — | — | 5380 | 5460 |

As will be apparent from Table 1, as the molecular weight of polyethylene glycol increased, the amount of static electricity generated decreased. As compared to monovinyl compounds, divinyl and trivinyl compounds were very excellent in durability and adhering property; and it was apparent that the molecular weight of the polyoxyethylene segment of at least 1000 imparted excellent antistatic properties. The thicknesses of films of m1 – m4 at that time were about 0.8μ, based upon observation under an electron microscope.

EXAMPLE 2

A tricot knitted fabric was obtained by knitting a 40 denier/10 filament polyamide yarn consisting of E-caprolactem subjected to pre-heatsetting and scouring. Using, as composition of a solution containing said polymerizable unsaturated vinyl, a 5% by weight aqueous solution of polyethylene glycol diacrylate the molecular weight of whose polyoxyethylene segment was 1000, added with 0.5% by weight of a polymerization initiator, potassium persulfate and said sample was treated same as in Example 1. At that time, the amount adhered was adjusted to 79% by weight. Next, one part of the obtained sample was treated at 105° C for 5 minutes with heated aqueous vapor, while the other part was dried at 110° C and, thereafter, dry heat-treated at 160° C for 45 seconds. The so-treated coated sample was subjected to soaping, washing with water and drying as in Example 1. The test items to be measured and the method of measuring were completely the same as in Example 1, and the results obtained appear in Table 2.

Table 2

| M* W* | Amount Adhered (%) | | | Amount of static electricity (V) | |
|---|---|---|---|---|---|
| Treating Method | Before | After | Falling Ratio | Before | After |
| Dry heat treatment | 0.6 | 0.41 | 31.1 | 3250 | 4360 |
| Steam heat treatment | 3.5 | 3.1 | 11.4 | 238 | 326 |

Table 2-continued

| M* W* Treating Method | Amount Adhered (%) Before | After | Falling Ratio | Amount of static electricity (V) Before | After |
|---|---|---|---|---|---|
| Blank | — | — | — | 8820 | 9050 |

Note
M* stands for Measured.
W* stands for Washing.

Table 2 shows that the polymerizable compound was unlikely to initiate polymerization in the presence of air such as by a dry heat-treatment, but was capable of completing polymerization in the presence of steam, such as by a wet heat-treatment. However, in dry heat-treatment, some effects were recognized. Table 2 also showed that polymerization was possible in a vapor of the solvent used for the padding bath. In a system in which a large amound of air did not exist, the reaction proceeded the same as in a so-called general vinyl polymerization.

EXAMPLE 3

A 48-count single yarn consisting of polyacrylonitrile was used. A 2-ply knitted fabric was subjected to conventional scouring and was immersed in a padding bath obtained by adding 0.5% by weight of a polymerization initiator, APS to a 3% by weight aqueous solution of polyethylene glycol diacrylate containing a polyoxyethylene segment having a molecular weight of 1000. The fabric was uniformly squeezed to adjust the amount adhering to 125% by weight, and thereafter heat-treated at 105° C for 5 minutes with steam. On the other hand, the fabric was immersed in a padding bath obtained by adding 0.3% by weight of a polymerization initiator APS to a 1% by weight aqueous solution of a polymer the same as that mentioned above and heated to 100° C. Thereafter, said two fabrics were subjected to treatment and testing the same as in Example 1, and the results are shown in Table 3.

Table 3

| M* W* Treating Method | Amount Adhered (%) Before | After | Falling Ratio | Amount of static electricity (V) Before | After |
|---|---|---|---|---|---|
| *Immersion treatment | 0.60 | 0.50 | 17.0 | 2650 | 2400 |
| Steam treatment | 3.52 | 3.08 | 12.5 | 820 | 980 |
| Blank | — | — | — | 7350 | 7640 |

Note
M* stands for Measured.
W* stands for Washing.
*Immersion treatment: The padding bath was heated to 100° C, in which the sample was immersed for a predetermined time.

As shown in Table 3, the sample subjected to immersion treatment was poor in adhered amount and antistatic properties. In immersion treatment, as heating proceeded, homopolymerization proceeded, and when the temperature reached 100° C, gelation was brought about immediately (within 10 minutes). Accordingly, formation of a film on the surface of the fiber was difficult. However, the immersion method was not entirely unsatisfactory, but some improvements were brought about.

EXAMPLE 4

A crepon fabric obtained by weaving a 50 denier/24 filament polyolefin filament yarn was scoured as in Example 1 and immersed in a padding bath obtained by adding 0.5% by weight of a polymerization initiator, benzoyl peroxide to a 5% by weight tetrachloroethylene solution of polyethylene glycol trimethacrylate containing a polyoxyethylene segment having a molecular weight of 1000. The amount adhered was adjusted to 43%, the fabric was treated at 120° C for 3 minutes in a saturated vapor of tetrachloroethylene, immersed in acetone at 50° C for 20 hours to remove homopolymer and thereafter dry heat-treated at 160° C for 1 minute. Thereafter, the fabric was treated in the same way as in Example 1 to obtain the results appearing in the following Table 4.

Table 4

| M* W* Treating Method | Amount Adhered (%) Before | After | Falling ratio | Amount of static electricity (V) Before | After |
|---|---|---|---|---|---|
| Solvent treatment | 1.97 | 1.76 | 10.6 | 730 | 860 |
| Blank | — | — | — | 10000< | 10000< |

Note
M* stands for Measured.
W* stands for Washing.

As will be apparent from Table 4, when carrying out a solvent treatment, the object of the present invention was sufficiently achieved.

EXAMPLE 5

A polyester fabric the same as in Example 1 was immersed and padded in a 3% by weight aqueous solution of a compound of the formula

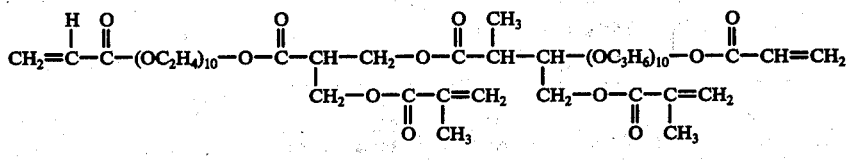

added with 0.5% by weight of potassium persulfate, the fabric was squeezed to an adhered ratio of 90% and thereafter treated in steam for 5 minutes. Thereafter, the fabric was soaped in the same way as in Example 1 and then measured for adhered amount, to obtain 25%. When the rubbing voltages before washing and after washing for 10 times on this sample were measured, the results were 550 v and 280 V, respectively at 20° C and 40% RH.

EXAMPLE 6

A list of tested samples is shown in Table 5 which follows. The polyester used herein was a normal polyester fiber consisting of ethylene glycol and terephthalic acid for clothing and the polyamide used herein was ordinary nylon 6 obtained by polymerizing caprolactam.

Table 5

| No. | Material | Denier-number of filaments | Name of knitted or woven fabric | Thickness (mm) | Density (g/cm³) |
|---|---|---|---|---|---|
| 1 | Polyester | 50 – 24 | Twill | 0.085 | 0.70 |
| 2 | Polyester | 75 – 24 | Twill | 0.14 | 1.03 |
| 3 | Polyester | 250 – 84 | Mat worsted* | 0.55 | 0.23 |
| 4 | Polyester 65% rayon 35% | A** | Poplin | 0.31 | 0.15 |
| 5 | Polyamide | 50 – 24 | Taffeta | 0.080 | 0.73 |
| 6 | Polyamide | 50 – 24 | Jersey | 0.58 | 0.21 |

Note:
*using a processed yarn
A** S twist 40 s/2, S (Z) twist 30 s/2

Before the samples were subjected to antistatic processing, they were subjected to the following treatments:

Ordinary fabrics, after being heated at 180° C for a few seconds, were scoured for 30 minutes in an aqueous solution containing 2 g/liter of soda ash and 1 g/liter Sandet CL-80 (a non-ionic surface active agent, manufactured by Sanyo Kasei Co., Ltd.).

Knitted and woven fabrics using processed yarns were treated in relaxed condition at 30° C for 30 seconds in water and thereafter subjected to a similar scouring, and then were heated at 180° C for 30 seconds.

An aqueous solution containing 2% by weight of polyethylene glycol dimethacrylate, the molecular weight of whose polyethylene glycol portions was 1000, and 0.3% by weight of ammonium persulfate were padded on the samples of Table 5.

The samples were heated in steam at 105° C for 2 minutes. Thereafter, the samples were scoured and washed and measured for rubbing voltage at 20° C and 40% RH to obtain the results of Table 6.

Table 6

| No. | Sample (No. of Tables 5) | Pick up (%) | Rubbing voltage (V) Original fabric | After being washed |
|---|---|---|---|---|
| 1 | 1 | — | 4200 | 5600 |
| 2 | 2 | — | 5600 | 8100 |
| 3 | 3 | — | 5300 | 5400 |
| 4 | 4 | — | 3600 | 5400 |
| 5 | 5 | — | 3900 | 4300 |
| 6 | 6 | — | 6100 | 6300 |
| 7 | 1 | 40 | 450 | 3100 |
| 8 | 2 | 41 | 320 | 2900 |
| 9 | 3 | 92 | 100 | 520 |
| 10 | 4 | 83 | 200 | 630 |
| 11 | 5 | 40 | 610 | 3250 |
| 12 | 6 | 90 | 360 | 1100 |

From Table 6, it is understood that samples Nos. 3, 4 and 6 having low densities show excellent antistatic properties. As compared with the date of Nos. 1 to 6, it is apparent that by using steam, better antistatic properties were obtained.

EXAMPLE 7

A 75 denier/24 filament polyester yarn consisting of polyethylene terephthalate was false twisted to make a woven fabric of a tropical tone. Said fabric was scoured by known methods and washed well with water and dried. Separately, processing liquids shown in Table 7 were prepared.

Table 7

| Treating liquid * | Ratio of mixed processing agents (g/g)* | |
|---|---|---|
| 1 | Methoxypolyethylene glycol methacrylate** /trimethylolethane trimethacrylate = | 20/0 |
| 2 | " | 20/0.2 |
| 3 | " | 20/0.6 |
| 4 | " | 20/1 |
| 5 | " | 20/2 |
| 6 | " | 20/8 |
| 7 | " | 20/10 |
| 8 | " | 20/11 |

Note
*Showing a mixed ratio in 1 liter of an aqueous solution.
**The molecular weight of whose polyoxyethylene portion was 1000.

As to trimethlolethane trimethacrylate in Table 8, after a predetermined amount was collected, it was dissolved in a small amount of toluene, to which solution OT-221 (non-ionic surface active agent, manufactured by Nippon Oil and Fat Co., Ltd.) was added as a dispersing agent to prepare an emulsion and thereafter it was dispersed in water and used. In each of the prepared liquids, ammonium persulfate was added at a concentration of 2 g/liter as a polymerization catalyst.

In the processing liquids so prepared, said tropical fabric was immersed and uniformly squeezed by a padder. The pickup ratio at that time was 64%. Next, said fabric was heat-treated in a steam atmosphere at 110° C for 5 minutes. Further, said fabric was subjected to soaping (Marseille soap, 0.05% by weight, 50° C, 1 minute) and thoroughly washed with water and then dried. The results appear in Table 8.

Table 8

| Processing 1*m | E* W* | Rubbing voltage (V) 0 | 1 | 30 | Adherence ratio of resin (%) 0 | 1 | 30 |
|---|---|---|---|---|---|---|---|
| 1 | | 700 | 5800 | 6100 | 1.2 | 0 | 0 |
| 2 | | 650 | 3300 | 5700 | 1.2 | 0.04 | 0 |
| 3 | | 420 | 2100 | 2900 | 1.2 | 1.0 | 1.0 |
| 4 | | 300 | 670 | 1500 | 1.4 | 1.4 | 1.3 |
| 5 | | 340 | 450 | 1100 | 1.9 | 1.9 | 1.7 |
| 6 | | 1100 | 1500 | 2100 | 2.2 | 2.1 | 2.1 |
| 7 | | 2100 | 2300 | 2500 | 2.4 | 2.4 | 2.0 |
| 8 | | 2400 | 2650 | 3800 | 2.4 | 2.4 | 2.1 |
| Untreated | | 6500 | 6200 | 6300 | — | — | — |

Note
E* stands for estimated item.
W* stands for washing frequency (time).
L* stands for liquid.

From the aforesaid results, it is apparent that when the amount of trimethylolethane trimethacrylate became at least 3% by weight based on the weight of methoxypolyethylene glycol methacrylate, an effect like that of a cross-linking agent appeared and the amount of the resin adhered became unchanged by washing. At the same time, the rubbing voltage increased with respect to durability, becoming good. On the other hand, when said amount became at least 50% by weight, the ratio of the adhered resin became large and the degree of decreasing of said ratio by washing was small. However, the rubbing voltage became poor.

EXAMPLE 8

Besides a polyester fabric of the tropical tone used in Example 7, a 2-ply polyacrylic fiber knitted fabric using a 48 count single yarn and a polypropylene crepon fabric using a 50 denier/24 filaments filament yarn (each after being scoured and dried) were used.

Tetramethylolmethane tetramethacrylate was so picked as to become 2 g/liter to 29 g/liter of a compound of the formula

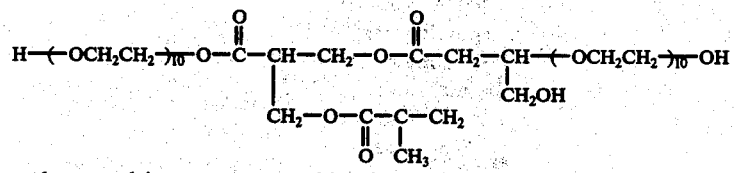

and an emulsion was prepared by the method of Example 7. A similar aqueous dispersed liquid containing 2 g/liter of ammonium persulfate was prepared, in which the aforesaid fabrics were immersed and padded, and thereafter subjected to a treatment with steam, and thereafter fabrics were measured with respect to rubbing voltage. The results appear in Table 9 and Table 10.

Table 9

| Sample | E* W* | Rubbing voltage (V) 0 | 1 | 30 | Non-processed (before washing) |
|---|---|---|---|---|---|
| Polyester tropical fabric | | 520 | 550 | 1600 | 6500 |
| Polyacryl 2-ply knitted fabric | | 460 | 600 | 2100 | 10000< |
| Polypropylene crepon fabric | | 1050 | 1300 | 2900 | 10000< |

E* stands for estimated item.
W* stands for washing frequency (time).

Table 10

| Sample | E* W* | Rubbing voltage (V) 0 | 1 | 30 |
|---|---|---|---|---|
| Processed fabric | | 680 | 720 | 1700 |
| Non-processed fabric | | 9400 | 9000 | 9000 |

note
E* stands for estimated item.
W* stands for washing frequency (time).

EXAMPLE 9 a. 20 g of methoxypolyethylene glycol methacrylate the molecular weight of whose polyoxyethylene portion was 400 and 2 g of trimethylolethane trimethacrylate were dissolved and mixed by the method of Example 7. To this mixture water was added in an amount to prepare 1 liter of a processing liquid.

b. A processing liquid completely identical with the above (a) except that the molecular weight of the polyoxyethylene portion was 2000, was prepared.

Into each of the aforesaid two processing liquids, the same fabric used in Example 7 was immersed, uniformly squeezed by a padder, similarly heat-treated and measured for rubbing voltages (V) and ratio of adhered resin. The results appear in Table 11.

Table 11

| Sample | E* W* | Rubbing voltage (V) 0 | 1 | 30 | Ratio of adhered resin (%) 0 | 1 | 30 |
|---|---|---|---|---|---|---|---|
| a | | 1300 | 1520 | 2800 | 1.9 | 1.7 | 1.7 |
| b | | 280 | 470 | 1300 | 1.4 | 1.4 | 1.2 |

E* stands for estimated item.
W* stands for washing frequency (time).

As will be apparent from Table 11, although not greatly affected by the molecular weight of the polyoxyalkylene portion, material treated by a processing liquid whose said portion had a relatively high molecular weight showed a preferable result.

However, as will be understood from other examples, from the viewpoint of synthetic technology and effect, it could be said that the optimum treating liquid had a polyoxyalkylene portion whose molecular weight was about 1000 - 5000.

EXAMPLE 10

A taffeta fabric consisting of 50 denier/24 filament yarn of polyethylene terephthalate obtained by mix-spinning 1.5% of sodium dodecylbenzenesulfonate as an ion component and 1.5% of polyethylene glycol having a molecular weight of 20,000 as an electric conductive component with polyethylene terephthalate was scoured in an aqueous solution containing 1 g/liter of soda ash and 2 g/liter of a nonionic surface active agent, Sandet CL-80 (manufactured by Sanyo Kasei Co., Ltd.), and dyed in 2% of Mice White STN (manufactured by Nippon Kayaku Co., Ltd.) at 120° C for 120 mintues and dried. Using this sample, the following antistatic treatments were carried out.

| m | Processing agent | Concentration (g/liter) | Treating conditions |
|---|---|---|---|
| 1 | Polyethylene glycol (molecular weight 600) dimethacrylate | 20 | Treated with a 2 g/liter stream of ammonium persulfate solution at 105° C for 5 min. |
| 2 | Polyethylene glycol (molecular weight 600) methacrylate | 20 | Treated with a 2 g/liter stream of ammonium persulfate solution at 105° C for 5 min. |
| 3 | Polyethylene glycol (molecular weight 1000) trimethacrylate | 20 | " |
| 4 | None | | " |

A polyester fiber which had not been mixed with antistatic processing agents was made into a faffeta fabric the same as mentioned above, which fabric was scoured and dyed with a fluorescent dyestuff, and the dyed fabric was treated the same as m1 - 4 and designated m5, 6, 7 and 8.

Samples after the treatment were subjected to scouring the same as before dyeing in order to remove a polymer that was a homopolymer and in a condition to fall off easily. After drying, the samples were measured as to weight increase, rubbing voltage and water-absorbing property. The results are shown in Table 12.

Table 12

| m | Sample | Processing agent | Ratio of weight increase (%) | Rubbing voltage (V) W 0* | W 2** | Water-absorbing property W 0* | W 2** |
|---|---|---|---|---|---|---|---|
| 1 | Modified polyester | Diester | 0.7 | 240 | 490 | 0.8 | 38.0 |
| 2 | " | Monester | 0.1 | 1050 | 2600 | 0.8 | 600< |
| 3 | Modified polyester | Triester | 0.8 | 210 | 520 | 0.6 | 35.0 |
| 4 | " | Non-processed | 0.0 | 2600 | 3100 | 250 | 600< |

Table 12-continued

| m | Sample | Processing agent | Ratio of weight increase (%) | Rubbing voltage (V) | | Water-absorbing property | |
|---|---|---|---|---|---|---|---|
| | | | | W 0* | W 2** | W 0* | W 2** |
| 5 | Unmodified polyester | Diester | 0.7 | 650 | 1500 | 0.9 | 510 |
| 6 | " | Monoester | 0.1 | 1560 | 5300 | 2.1 | 600< |
| 7 | " | Triester | 0.7 | 590 | 1400 | 0.8 | 630 |
| 8 | " | Non-processed | 0.0 | 5600 | 6800 | 240 | 600 |

W 0* means washed for zero time.
W 2* means washed 2 times.

From the results for samples m1 and m3, it is established that when diester or triester was applied to a modified polyester, the antistatic properties improved, especially. Washing resistance was excellent.

EXAMPLE 11

A salt consisting of equimolar amounts (mixture) of polyethylene oxide having an average molecular weight of about 4300, 95% of both ends of which had been converted to amino groups and adipic acid, and E-caprolactam, were used to obtain a block polyether amide the weight ratio of whose polyethylene segment was 40%. This block polyether amide, 0.2% of titanium dioxide and nylon 6 were mix-spun to obtain a 30 denier/6 filament yarn of modified polyamide the amount of whose polyethylene oxide segment was 1.5% by weight. This yarn was knitted into a 28 gauge, 2 bar, 88 inch, 74 course/inch knitted fabric. After scouring said fabric in a relaxed state, it was dried and then treated with treating liquids whose formulations are shown in Table 13 (Nos. 1, 2, 3, 4, 5). The amounts adhered at that time were about 80% each.

Table 13

| N P* | Formulation of treating agent |
|---|---|
| No. 1 | A treating liquid obtained by dissolving in water 3% by weight of polyethylene glycol dimethacrylate the molecular weight of whose polyoxyethylene segment was 500 and adding 0.3% by weight of ammonium persulfate as a polymerization initiator to the aqueous solution obtained. |
| No. 2 | A treating liquid obtained by dissolving in water 3% by weight of polythylene glycol dimethacrylate the molecular weight of whose polyoxyethylene segment was 1000 and adding 0.3% by weight of ammonium persulfate as a polymerization initiator to the aqueous solution obtained. |
| No. 3 | A treating liquid obtained by dissolving in water 3% by weight of polyethylene glycol dimethacrylate the molecular weight of whose polyoxyethylene segment was 2000 and adding 0.3% by weight of ammonium persulfate as a polymerization initiator to the aqueous solution obtained. |
| No. 4 | A treating liquid obtained by dissolving in water 3% by weight of polyethylene glycol trimethacrylate the molecular weight of whose polyoxyethylene segment was 1000 and adding 0.3% by weight of ammonium persulfate as a polymerization initiator to the aqueous solution obtained. |
| No. 5 | 10 A treating liquid obtained by dissolving in water 3% by weight of polyethylene glycol monomethacrylate the molecular weight of whose polyoxyethylene segment was 1000 and adding 0.3% by weight of ammonium persulfate as a polymerization initiator to the aqueous solution obtained. |

P* stands for Prescription or Formulation.
N* stands for No. of treating liquid.

Immediately after each of the aforesaid treating liquids described in Table 13 was prepared as a padding bath, said fabric was immersed therein and uniformly squeezed by a padder. Next, the resultant fabrics were treated at 105° C for 3 minutes in the presence of heated aqueous vapor. Thereafter, the unreacted substance was removed by soaping (Marseille soap, 0.05% by weight, 50° C, 5 minutes) and the fabrics were well washed with water and dried. The measured ratio of weight increase, water-absorbing time and rubbing voltage of the samples obtained are shown in Table 14.

Table 14

| Treatment No. | Ratio of weight increase (%) | Water-absorbing time (second) Washed for 5 times | Rubbing voltage (V) Washed for zero time | Rubbing voltage (V) Washed for 2 times |
|---|---|---|---|---|
| 1 | 1.5 | 3.8 | 320 | 650 |
| 2 | 1.6 | 4.0 | 210 | 520 |
| 3 | 1.4 | 5.0 | 360 | 680 |
| 4 | 1.3 | 6.1 | 380 | 580 |
| 5 | 0.2 | 600 | 700 | 1900 |
| 6 | Untreated blank | 600 | 2200 | 1800 |

According to Table 14, it is apparent that in case of Nos. 1 – 4 that ratios of weight increase were large and durability of water-absorption property and antistatic property was remarkably excellent. In case No. 5, involving processing by the monovinyl monomer, there was almost no increase of weight and no effect was recognized.

EXAMPLE 12

A 250 denier/84 filaments polyester filament yarn consisting of polyethylene terephthalate was false twisted, thereafter, woven into a fabric, which was scoured in a relaxed state to obtain a sample having a unit weight of 300 g/m². Using this sample, treatments shown in Table 15, were carried out to obtain the results shown in Table 16.

Table 15

| No. | Processing agent | Concentration (g/liter) | Polymerization initiator |
|---|---|---|---|
| 1 | Methoxypolyethylene glycol (molecular weight 600) methacrylate | 5 | 2 g/liter of ammonium persulfate |
| 2 | " | " | 0.5 g/liter of benzoyl persulfate was dissolved in acetone, thereafter, the resultant solution was dispersed in a treating bath |
| 3 | Polyethylene glycol (molecular weight 600) dimethcrylate | " | 2 g/liter of ammonium persulfate |
| 4 | " | " | 0.5 g/liter of benzoyl persulfate was dissolved on acetone, thereafter, the resultant solution was dispersed in a treating bath |
| 5 | Polyethylene glycol (molecular weight 1000)ω-α,α-dimeth acryloxymethyl) acetate acrylate | " | " |
| 6 | Polyethylene glycol (molecular weight 1000) diacrylate | " | 0.5 g/liter acetyl peroxide was dispersed in a treating bath |

The sample was treated by an immersion method at 100° C for 30 minutes at a bath ratio of 1 : 50 and thereafter subjected to soaping at 80° C for 30 minutes with an aqueous solution containing 2 g/liter of a nonionic surface active agent Sandet CL-80 (manufactured by Sanyo Kansei Co., Ltd.) and 1 g/liter of soda ash.

Table 16

| m of Table 5 | Ratio of weight increase (%) | Rubbing voltage (V) Before washing | After being washed for 10 times |
|---|---|---|---|
| 1 | 0.0 | 6100 | 5800 |
| 2 | 0.2 | 3600 | 6200 |
| 3 | 0.1 | 3100 | 6500 |
| 4 | 12.1 | 450 | 640 |
| 5 | 11.6 | 180 | 480 |
| 6 | 10.2 | 170 | 5200 |

From the results of Table 16, it is apparent, that in the case of methacrylate having one vinyl group, weight increase and improvement of antistatic property could not be achieved regardless whether a hydrophilic or hydrophobic polymerization initiator was used (m 1, 2). However, with methacrylate having 2 - 3 vinyl groups (m 3 - 6), a significant weight increase appeared when a hydrophobic polymerization initiator was used, and the antistatic properties became excellent (m 4, 5, 6). When using a hydrophilic polymerization initiator, ammonium peroxide, as seen in m3, even though the number of vinyl groups was made 2, the weight increased only a little.

EXAMPLE 13

Using the sample of Example 12, it was treated at 98° C for 30 minutes in an aqueous dispersed liquid containing 5 g/liter of polyethylene glycol diacrylate containing quaternary nitrogen represented by the following formula and 0.5 g/liter of benzoyl peroxide, thereafter dried and the ratio of weight increase was measured. However, no increase of weight was observed. The formula was:

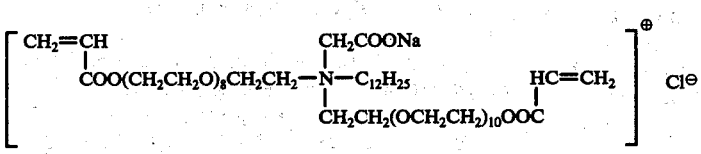

EXAMPLE 14

A polyester tow whose filament denier was 2 and whose total denier was 400,000, was immersed in a liquid obtained by dispersing 10 g/liter of polyethylene glycol dimethacrylate the molecular weight of whose polyethylene glycol portion was 800 and 1 g/liter of benzoyl peroxide in water at a bath ratio of 1 : 30 and treated at 90° C for 60 minutes. After it was treated, the tow was washed well with water and dried. Thereafter, the ratio of weight increase was measured and an increase of 11.1% was observed.

EXAMPLE 15

In a 500 ml beaker, 300 ml of a mixture of a 20 g/liter aqueous solution of polyethylene glycol dimethacrylate the molecular weight of whose polyethylene glycol segment was 1000 and a 5 g/liter aqueous solution of ammonium persulfate was placed. Two lots of a liquid of the aforesaid composition were prepared. One was allowed to stand at room temperature (20° C). To the other, air was continuously introduced via a glass pipe at a rate of 120 ml/min, the mixed aqueous solution was allowed to stand gelled within 4.4 hours. However, the mixed aqueous solution to which air had been introduced did not polymerize and was stable after 50 hours. Thereafter, when introduction of air was stopped, the mixed aqueous solution gelled within 2 hours.

Next, results of experimenting with the stability of the vinyl monomer in the aqueous solution when changing the concentration of polyethylene glycol dimethacrylate and ammonium persulfate are shown in Table 17. At that time, coloration of the treating liquid did not occur. Further, a liquid of No. 4 of Table 17 allowed to pass 50 hours, was padded to polyester taffeta so that the adhered taffeta was treated with steam at 105° C for 5 minutes to obtain the ratio of weight increase of 1.3%.

Table 17

| No. | Concentration of monomer (g/liter) | Concentration of initiator (g/liter) | Conditions | Celled (polymerization) time (hr) | Other |
|---|---|---|---|---|---|
| 1 | 20 | 5 | Allowed to stand | 4.4 | |
| 2 | " | " | Treated with air* | 50 | Gelled within 2 hrs after stopping air treatment |
| 3 | 40 | " | Allowed to stand | 4.6 | |
| 4 | " | " | treated with air* | 50 | Gelled within 2 hrs after stopping air treatment |
| 5 | 20 | 10 | Allowed to stand | 4.5 | |
| 6 | " | " | Treated with air* | 50 | Gelled within 2 hrs after stopping air treatment |
| 7 | 40 | " | Allowed to stand | 2.4 | |
| 8 | " | " | Treated with air* | 50 | Gelled within 2 hrs after stopping air treatment |
| 9 | 40 | 20 | Allowed to stand | 1.3 | |
| 10 | " | " | Treated with air* | 50 | Gelled within 2 hrs after stopping air treatment |

Liquid temperature 25° C.
* Amount of air supplied 120 ml/min (liquid 300 ml)

EXAMPLE 16

A padding apparatus was so made as to immerse a portion of 10 cm in a lengthwise direction of a 100 cm long and 15 cm wide polyester mat worsted fabric in a mixture of a 20 g/liter aqueous solution of polyethylene glycol dimethyacrylate the molecular weight of whose polyethylene glycol portion was 1000 and a 5 g/liter aqueous solution of ammonium persulfate, and when said fabric was rotated by a motor to circulate said fabric in said mixed aqueous solution at room temperature (20° C), even after a period of 50 hours, said aqueous solution was stable without gelation. On the other hand, when the same mixed aqueous solution was allowed to stand, it gelled within 4.5 hours. When the aforesaid run was repeated except that the circulating fabric was changed to a thin polyester twill having a unit weight of 70 g/m², it was observed that no gelation took place. When said mixed aqueous solution was placed in a 1 liter beaker and oxygen was introduced at a flow rate of 4.2 ml/min, the solution did not gel. Further, when a similar run was carried out by reducing the air flow rate to 2.1 ml/min, it was observed that no gelation took place. Next, when a similar run was carried out by further reducing the air flow rate to 1.05 ml/min, at which oxygen was introduced into 1 liter of said mixed aqueous solution, after a period of 30 hours, it was shown that the viscosity rose and that polymerization started.

The following is claimed:

1. A process for imparting antistatic, soil release and water-absorbing properties to a synthetic fiber structure which comprises adhering to the fiber structure a compound selected from the group consisting of diacrylate, dimethacrylate, triacrylate and trimethacrylate compound having a polyalkylene oxide segment which has a molecular weight of from 400 to 10,000 and which includes an alkylene substituent selected from the group consisting of ethylene groups, propylene groups and a mixture of ethylene groups and propylene groups, and after such adhesion heat-treating the adhered compound and fiber structure in the presence of moisture, whereby polymerization of said compound is carried out on the fiber to form a uniform and smooth film having a thickness of about 0.01 -10μ and the surface of the fiber is covered by said polymer film of said compound.

2. The process according to claim 1, wherein after adhesion the structure is treated at 80°-150° C in an atmosphere containing about 80 - 100% of steam.

3. The process according to claim 1, wherein said fiber structure is immersed in an aqueous solution of said compound and subjected to a heat polymerization treatment.

4. The process according to claim 1, wherein said polymerization is carried out using, as a polymerization initiator, a dispersed system of a hydrophobic polymerization initiator selected from the group consisting of ammonium persulfate, potassium persulfate, benzoyl peroxide and azobisisobutylenitrile.

5. The process according to claim 1, wherein said fiber structure is a yarn.

6. The process according to claim 1, wherein said fiber structure is a knitted or woven fabric.

7. The process according to claim 6, wherein the density of said fabric is equal to or less than 0.5 g/cm³

8. The process according to claim 1, wherein said compound and a quanternary ammonium compound are used concurrently.

9. The process according to claim 8, wherein the amount of said quanternary ammonium compound is about 0.03 - 10% by weight calculated as solid, based on the weight of the fiber.

10. The process according to claim 1, wherein said compound and an alkyl ethylene urea represented by the following formula are used concurrently

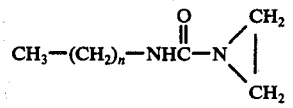

(wherein 5 ≦ n ≦ 30).

wherein 5 ≦ n ≦ 30.

11. The process according to claim 10, wherein the amount of said alkyl ethylene urea is about 0.03 - 10% by weight calculated as solid, based on the weight of the fiber.

12. The process according to claim 1, wherein said compound, a quanternary ammonium compound and an alkyl ethylene urea represented by the following formula are used concurrently

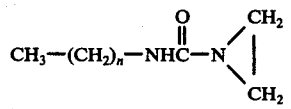

(wherein 5 ≦ n ≦ 30).

wherein 5 ≦ n ≦ 30.

13. The process according to claim 12, wherein the amount of said quanternary ammonium compound and said alkyl ethylene urea is about 0.03 - 10% by weight calculated as solid, based on the weight of the fiber.

14. The process according to claim 1, wherein upon using said compound, a gas containing oxygen is positively poured into the compound solution.

15. The process according to claim 14, wherein the amount of oxygen poured is equal to or greater than 2.1 cc/liter min.

16. A process for imparting antistatic, soil release and water-absorbing properties to a synthetic fiber structure which comprises adhering to said fiber structure a mixture of a. a compound selected from the class consisting of polyethylene glycol methacrylate, methoxy polyethylene glycol acrylate, methoxy polyethylene glycol methacrylate, ethoxy polyethylene glycol acrylate, ethoxy polyethylene glycol methacrylate, chlorinated polyethylene glycol methacrylate, polypropylene glycol methacrylate, methoxy propylene glycol acrylate, polypropylene glycol acrylate, methyl sulfide polyethylene glycol methacrylate and compounds having a vinyl group as a side chain as follows:

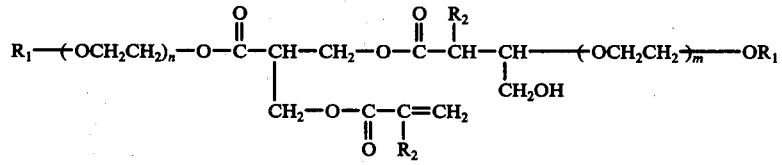

wherein $R_1$ and $R_2$ represent hydrogen, methyl or ethyl, and wherein n is an integer from 5 - 500, m is an integer from 5 - 500, the molecular weight of whose polyalkylene oxide segment is 400–10,000; with b. a compound selected from the group of a diacrylate, dimethacrylate, triacrylate or trimethacrylate compound having a polyalkylene oxide segment which has a molecular weight of from about 400 - 10,000 and which includes alkylene substituents selected from the group consisting of ethylene groups, propylene groups and mixtures thereof to the fiber, the mix ratio of the compound (b) being about 3.0 – 50.0% by weight based on the solid portion of the compound (a), and heat-treating the said mixture and the adhered fiber structure in the presence of moisture, whereby polymerization of said mixture is carried out on said fiber to form a uniform and smooth film, said film having a thickness of about 0.01 – 10μ and the surface of the fiber is covered by said polymer film of said mixture.

17. The process according to claim 16, wherein after adhesion the structure is treated at about 80° – 150° C in an atmosphere containing about 80 – 100% of steam.

18. The process according to claim 16, wherein said fiber structure is immersed in an aqueous solution of said mixture and subjected to a heat polymerization treatment.

19. The process according to claim 16, wherein said polymerization is carried out using, as a polymerization initiator, a dispersed system of a hydrophobic polymerization initiator selected from the group consisting of ammonium persulfate, potassium persulfate, benzoyl peroxide and azobisisobutylonitrile.

20. The process according to claim 16, wherein said fiber structure is a yarn.

21. The process according to claim 16, wherein said fiber structure is a knitted or woven fabric.

22. The process according to claim 21, wherein the density of said fabric is equal to or less than 0.5 g/cm.

23. The process according to claim 16, wherein said mixture and a quanternary ammonium compound are used concurrently.

24. The process according to claim 23, wherein the amount of said quanternary ammonium compound is about 0.03 – 10% by weight, calculated as solid, based on the weight of the fiber.

25. The process according to claim 16, wherein said mixture and an alkyl ethylene urea represented by the following formula are used concurrently

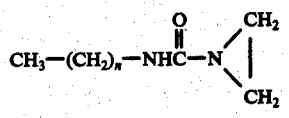

(wherein $5 \leqq n \leqq 30$).

wherein $5 \leqq 30 \leqq$.

26. The process according to claim 25, wherein the amount of said alkyl ethylene urea is about 0.03 – 10% by weight calculated as solid, based on the weight of the fiber.

27. The process according to claim 16, wherein said mixture, a quanternary ammonium compound and an alkyl ethylene urea represented by the following formula are used concurrently

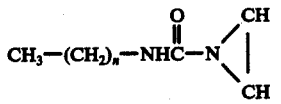

wherein $5 \leqq n \leqq 30$.

wherein $5 \leqq n \leqq 30$.

28. The process according to claim 27, wherein the amount of said quanternary ammonium compound and said alkyl ethylene urea is about 0.03 – 10% by weight, calculated as solid, based upon the weight of the fiber.

29. The process according to claim 16, wherein upon using said mixture, a gas containing oxygen is positively poured into the mixture solution.

30. The process according to claim 29, wherein the amount of oxygen poured is equal to or greater than 2.1 cc/liter min.

31. A synthetic fiber structure having antistatic, soil release and water-absorbing properties obtained by the process of claim 1.

32. A synthetic fiber structure having antistatic, soil release and water-absorbing properties obtained by the process of claim 16.

33. The process according to claim 1, wherein said synthetic fiber is a polyester.

* * * * *